United States Patent [19]

Sutton et al.

[11] Patent Number: 4,982,521

[45] Date of Patent: Jan. 8, 1991

[54] RECOIL SHOCK RELIEVING PAD FOR RIFLES

[75] Inventors: Fred A. Sutton, Auburn, Wash.; Marc H. Ratzlaff, Moscow, Id.

[73] Assignee: Technology Innovations, Inc., Renton, Wash.

[21] Appl. No.: 526,438

[22] Filed: May 21, 1990

[51] Int. Cl.[5] ..... F41C 23/08

[52] U.S. Cl. ..... 42/74

[58] Field of Search ..... 42/74

[56] References Cited

U.S. PATENT DOCUMENTS 328,930 10/1885 Finney ..... 42/74

2,767,500 10/1956 Alexander ..... 42/74

*Primary Examiner*—Charles T. Jordan

*Assistant Examiner*—Richard W. Wendtland

*Attorney, Agent, or Firm*—Robert W. Jenny

[57] ABSTRACT

The subject recoil pad for rifles and shotguns is a one-piece plastic spring comprising a base which attaches to the end of the butt of the rifle or shotgun, a working part which, in use, contacts the user's shoulder and two struts interconnecting the base and working part. In plan view the pad has an elongated egg shape, matching the shape of the end of the butt. The base, working part and struts are all essentially flat, the base and working part being parallel to each other and about ⅜ of an inch apart. The struts extend from the ends of the working part at an angle to the base so that the junctures of the struts and base are some distance from the ends of the base. The angles are in the range of 30° to 50° with 40° preferred. In operation the working part bends to help distribute recoil foces evenly over the area of the face of the working part and the struts' deflections decrease the angles, increasing the mechanical advantage of the struts in stretching the working piece, thus giving the pad a fairly load/deflection characteristic. The pad material is fully resilient with high internal damping.

2 Claims, 2 Drawing Sheets

FIG. 1
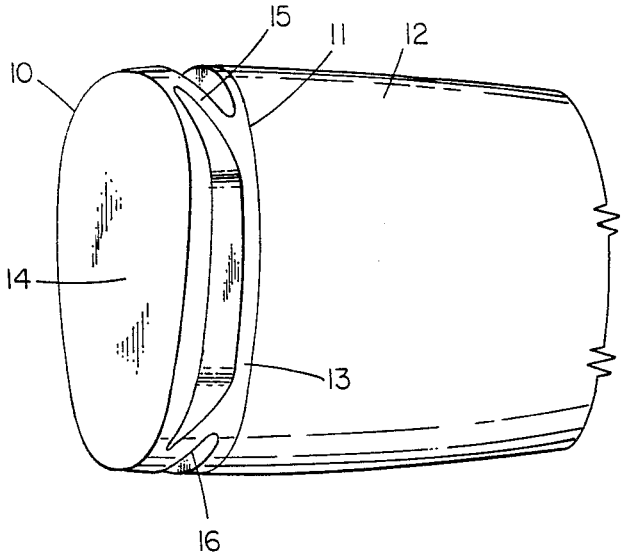
FIG. 2
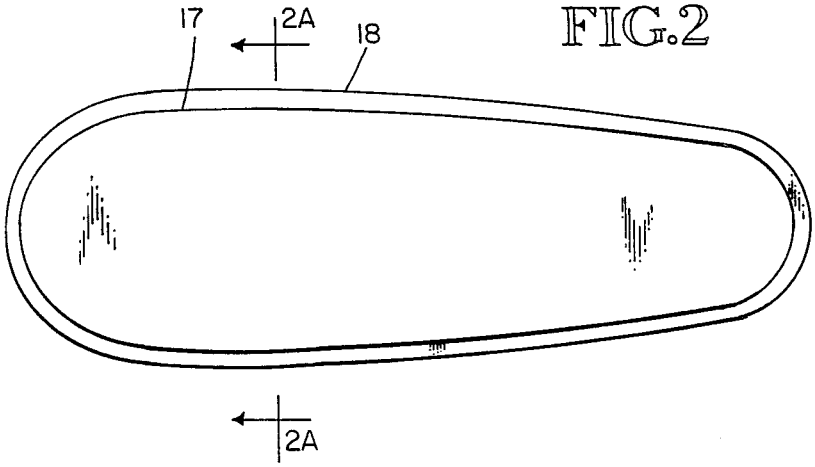
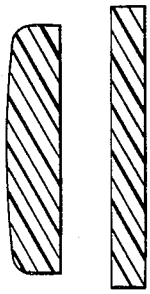
FIG. 2A

RECOIL SHOCK RELIEVING PAD FOR RIFLES

BACKGROUND OF THE INVENTION

1. Field:

The subject invention is in the field of shock absorbing and/or relieving apparatus, excluding apparatus which involves mechanisms such as metal springs and hydraulic energy absorbers. More specifically it is in the field of one piece pads made of resilient material and made to fit on the ends of rifle butts to cushion the blow on the user's shoulder caused by the firing of a bullet and the resultant recoil of the rifle.

2. Prior Art:

The patents listed here are a sampling of the prior art in this field and include for reference purposes some examples of mechanical devices built into the stocks of rifles:

| | | |
|---|---|---|
| 0,488,855 | 2,455,438 | 3,335,515 |
| 0,837,601 | 3,007,272 | 3,363,352 |
| 1,642,835 | 3,019,543 | 3,514,889 |
| 1,822,875 | 3,039,222 | 3,696,544 |
| 1,868,953 | 3,135,064 | 3,707,797 |
| 2,091,010 | 3,263,359 | |
| 2,330,430 | 3,274,725 | |
| 3,438,142 | 3,290,815 | |

The recoil of a rifle caused by the shooting of a bullet is known to comprise two peak loads, the first involving the acceleration of the mass of the bullet in the rifle barrel and the second being the rocket propulsion effect of the gases exiting the barrel once the bullet has left the barrel. These loads force the end of the rifle butt against the shoulder of the user of the rifle. The effects of the forcing of the butt end against the shoulder can vary widely and depend on many factors, including the distribution of the load over the area of the butt end and the functional characteristics of any apparatus attached to the butt end of minimize the magnitude of the forces applied to the shoulder. In any specific recoil there is a specific amount of work done by the recoil forces and the work can be plotted in terms of force moving the rifle a distance during the time the forces exist. Under ideal conditions, the force applied to the shoulder will be minimum if the force is constant throughout the distance the rifle recoils during the time the forces exist. Also, the effects of the force on the shoulder will be least harmful if the full butt area is in contact with the shoulder, keeping the force per unit area (pressure) on the shoulder at a minumum.

Further, the level of the recoil force is less for greater recoil deflections. However, practical considerations result in there being an optimum recoil distance in the range of ⅛" to ⅜" with ¼" preferred.

In the prior art pads the deflection of the pad for load distribution and the deflection for leveling of the force over the deflection distance are intermingled. There is little or no opportunity for distribution deflection to occur before the bullet acceleration force reaches its peak. Also, the load distribution deflection uses deflection which would otherwise be available for force leveling. Further, if the contours of the butt end shoulder do not match well the force is apt to be concentrated on an unnecessarily small area of the shoulder, increasing the contact area and related potential for harm.

Accordingly, the objectives of the subject invention are to provide a recoil pad in which (1) deflection of the pad to achieve uniform load distribution over the area of the pad and deflection for force leveling minimizing peak loads are essentially independent; (2) the load distribution occurs while recoil force absorption is at a relatively low level and (3) the force level during the time of recoil is close to uniform and thus minimum for the amount of work and recoil deflection limit involved.

SUMMARY OF THE INVENTION

A recoil pad, for rifles and meeting the stated objectives, comprises a base, a working member and struts interconnecting the base and working member. In a preferred embodiment the pad is an integral plastic part. The selected plastic material is resilient, with full recovery of its no-load shape after each deflection, and has high internal damping. That is, its recovery is relatively slow and a significant amount of the energy which deflects it is converted to heat and thus absorbed.

The base is a flat sheet approximately 3/16 of an inch thick, shaped in plan view to match the shape of the rifle butt end to which it is attached.

The working part is similarly shaped, however, the working surface, the surface which contacts the user's shoulder, is essentially flat with rounded edges and is arced transversely. The rounded corners and arced shape help prevent concentration of loads on the user's shoulder onto areas smaller than the total working area of the working face. The middle half of the working part, lengthwise, is approximately ⅜ of an inch thick and the thickness tapers to approximately ⅛ of an inch at each end at the junctures between the ends and the struts.

The struts are also flat sheets, extending across the pad between the base and working part and holding them essentially parallel to each other and approximately 5/16 of an inch apart over the middle third of the working pad. The struts extend from the ends of the working part and slope toward each other at equal angles to the working part so that they merge into the base at some distances from its ends. In other words, the struts extend from the base sloping away from each other. In a preferred embodiment the struts are at an angle in the range of 30° to 50° to the base in the relaxed condition. 40° is a preferred angle.

In operation, the working part bends to fit the user's shoulder under force applied by the user and the intial recoil force. This bending causes the recoil load to be distributed over the entire working area, minimizing unit pressure on the user's shoulder. As the recoil force increases the struts flex so that they are at smaller angles to the base. This action moves the strut ends at the working part farther apart, stretching the working part causing bending deformations at the junctures of the struts and base and working part. The resultant strain in the struts and working part produces a restoring force opposing the recoil force. As the angles between the struts and working part decrease the mechanical advantage of the struts in stretching the working part increases. The pad is designed so that the mechanical advantage increases almost in proportion to the tension load increase in the working part as it is stretched. The result is that the spring rate of the pad is essentially flat over the working deflection, the load increasing slightly with deflection. Also the load rises rapidly during the initial deflection. Given these spring characteristics the load transferred to the user's shoulder cannot exceed the spring force at any given deflection. As a result the characteristic peak loads produced by firing a rifle are "leveled." Ultimately the peaked variable force produced in the rifle by firing a bullet is opposed by forces of acceleration on the rifle and the user's shoulder and related body masses, the forces on the shoulder and body being smoothed and distributed by the pad.

If the pad material had low internal damping, instead of high internal damping and corresponding slow return after deflection, it would produce, in effect, a second recoil force on the user when it recovered from the deflection caused by the recoil, pushing the rifle away from the user in so doing. The second recoil would be a "mirror" repetition of the force applied by the pad to the user and its absence provides a distinct improvement in the function of the pad.

The invention is described in more detail below with reference to the attached drawings.

BRIEF DESCRIPTION OF THE DRAWINGS

FIG. 1 is a perspective view of the pad attached to the end of a rifle butt.

FIG. 2 is a view of the pad seen from the end of the rifle.

FIG. 2A is a section view taken at 2—2 in FIG. 2.

DETAILED DESCRIPTION OF THE INVENTION

Figure 3:
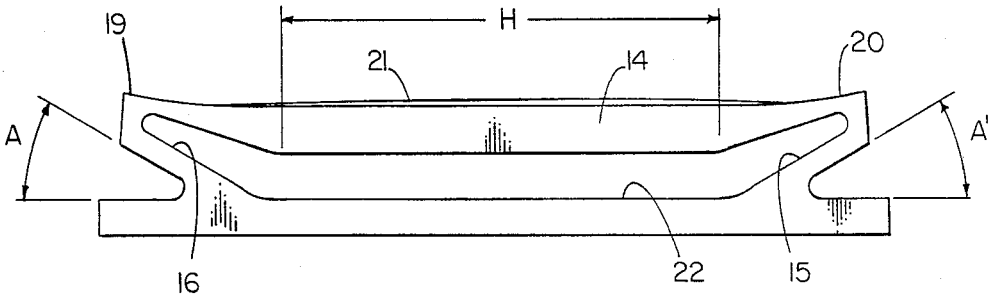
FIG. 3 is a side view of the pad.

The subject invention is a pad attachable to the ends of the butts of rifles and shotguns to soften the effects on the user of the contact between the rifles/shotguns and users when the rifles or shotguns are fired. For purposes of this description, the term rifle includes shotguns and rifles. Rifles recoil when fired because of the forces on the rifles causes by the acceleration of the bullets (or shot) and the jet propulsion effects of the discharge of gases from the barrels after the bullets have exited the barrels. A characteristic recoil comprises a first peak force due to bullet acceleration and a second due to gas discharge. These forces tend to accelerate the mass of the rifle and the portion of the user's body in contact with the rifle. All velocities of the rifle resulting from its acceleration by recoil forces are reduced to zero by reactionary deceleration forces developed in accelerations of the user's body portions. Without a recoil pad the user thus is subjected to two sharp forces each time the rifle is fired. The function of the pad is to convert the work done on the pad by the two sharp forces to one generally even lower level force which is applied to the user. The work done (average force times distance) by the combined two peaked forces is equal to the sum of work done by the single even lower level force and work converted to heat by the internal damping of the pad material. In this way the maximum force applied to the user is lowered, lessening chances for injury and decreasing discomfort.

FIG. 1 is perspective view of the subject rifle pad 10 attached to end 11 of rifle butt 12. Base 13 of the pad is attached to the butt end. Working part 14 is supported from the base by struts 15 and 16. In this preferred embodiment the base, working part the struts are all one piece. The preferred material is highly resilient plastic having high internal damping. The planview profiles of the base and working part are shown shaped to match the shape of the end of the butt for aesthetic reasons.

FIG. 2 is a view of the pad viewed from the end of the rifle butt and showing the planview profile 17 of the working part centered over the planview profile 18 of the base.

FIG. 3 is a side view of the strut in its no-load condition. The working part 14 is a beam supported at its ends 19 and 20 by the struts 15 and 16. The working surface 21 of the working part is essentially flat but is arced slightly transversely and symmetrically to its longitudinal axis and its edges are radiused, as indicated in FIG. 2A, a section taken at 2—2 in FIG. 2.

The middle portion H of the working part constitutes between $\frac{1}{3}$ to $\frac{1}{2}$ the total length of the working part and is approximately $\frac{3}{8}$ of an inch thick. The end portions of the part are tapered to a thickness of approximately $\frac{1}{8}$ of an inch at each end's juncture with a strut. The struts are essentially flat and approximately $\frac{1}{8}$ of an inch thick and are at 90° to the longitudinal axis of the working part. Angles A and A' between the struts and surface 22 of the base are in the range of 30° to 50° with 40° being preferred. The base is approximately 3/16 of an inch thick.

Figure 4:
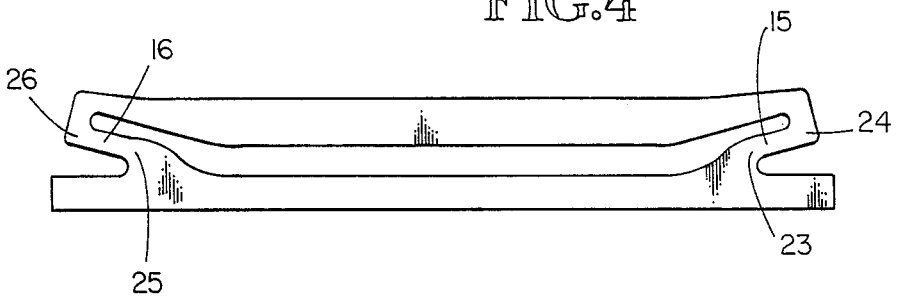
FIG. 4 is a view of the pad, partially deflected.

In FIG. 4, a side view of the pad partially deflected, the working part has been forced toward the base and angles A and A' have decreased. In the early stages of the deflection the tapered ends of the working part bend upward; i.e. up with respect to the working surface, helping the working surface to conform to the contours of the user's body and causing an initial restoring force which increases linearly with deflection. These deflections cause a restoring force in the pad because of (1) the bending of the struts and working part at the junctures between the struts and the base and working part and (2) the fact that the effective ends 23 and 24 of strut 15 and 25 and 26 of strut 16 are at greater distance from each other, measured in the direction parallel to the working surface, than they were before deflection began and this distortion causes compression loads in the struts and base and a tension load in the working part. All these loads contribute to the restoring force which opposes the recoil forces.

As angles A and A' decrease, the mechanical advantage of the struts increases. Theoretically, as angles A and A' approach zero, the mechanical advantage approaches infinity. With the bending, compression and tension forces varying essentially linearly with deflection, the effect of the mechanical advantage change is to allow more deflection per each subsequent, equal incremental increase in load. These characteristics give the pad spring rate characteristics discussed below wih reference to FIG. 5.

Figure 5:
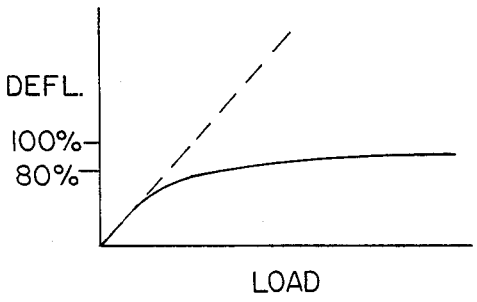
FIG. 5 is a plot of the load/deflection characteristic of the spring uniformly loaded.

FIG. 5 is a plot of the load/deflection characteristic of the pad, plotted in terms of load versus deflection. Without the effects of the mechanical advantage variation characteristics described above the spring rate would be linear as it is in the initial part of the deflection and as indicated by the dashed line. The effect of the mechanical advantage variation is to flatten the curve, producing load/deflection characteristic as indicated by the solid line. In the initial portion of the deflection the load increases essentially linearly with the deflection to at least 80% of the maximum load at maximum deflection. In the intermediate portion of the deflection the load remains between 80% and 100% of the maximum load and in the end portion the load decreases to zero.

Figure 6:
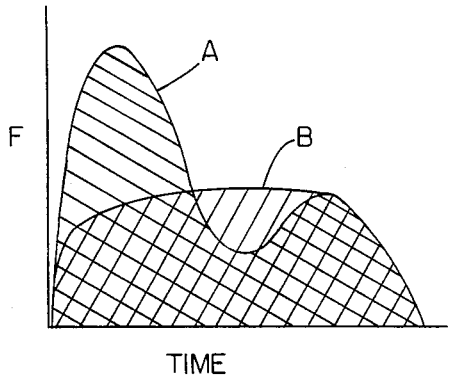
FIG. 6 is a plot of forces versus time during the recoil of a rifle, Curve A being the force applied to the pad from the rifle versus time and Curve B being the force applied by the pad to the user versus time.

FIG. 6 is a plot of the recoil force versus time applied to the pad by the rifle during a firing sequence (Curve A) and the force versus time applied to the user by the pad (Curve B). The areas under the curves are commensurate with the quantities of energy involved. The area under Curve B is less than that under Curve A by the quantity of energy converted to heat by the internal damping characteristic of the pad material. It can be seen from these curves that the force pattern applied to the user has a lower maximum level and is smoother than the force pattern applied to the pad by the rifle.

The pad is designed so that its work capacity is commensurate with the work done by the recoil forces during a recoil occurrence. The work of resisting the recoil is ultimately provided by the user's body; however, as noted, the high internal damping of the pad material causes the pad to convert a significant proportion of the work to heat and the load deflection characteristic smooths out the force versus time and deflection profiles reduce the maximum force applied to the user from the peak recoil forces to the load limit allowed by the pad as a spring. Theses characteristics of the pad, along with load distribution characteristics, enable the invention to meet its objectives. The initial deflection provides essentially uniform distribution of the recoil force over the area of the pad during the initial part of the recoild; the level of force applied to the user during the recoil is close to uniform during the time of recoil and the force distribution deflection is essentially independent of the shock relief and absorption deflection.

It is considered that it will be understood by those familiar with the art that while one embodiment of the invention is described herein, other embodiments and modifications of the one described are possible within the scope of the invention which is limited only by the attached claims.

We claim,

1. A pad for attachment to the ends of butts of rifles and shotguns, said pad comprising:

a working part having a longitudinal axis, a first end, a second end, a first planview profile and a base, said base having a second planview profile and being essentially a flat plate, a first strut being essentially a flat plate, a second strut being essentially a flat plate, said working part and said base being positioned essentially parallel to each other with said first planview profile centered with said second planview profile, said first strut being oriented at 90° to said longitudinal axis and extending from said first end of said working part to said base at a first angle to said base, said angle being in the range of 30° to 50°, said second strut being oriented at 90° to said longitudinal axis and extending from said second end of said working part to said base at a second angle to said base, said angle being in the range of 30° to 50°, said first and second struts being angled toward each other from said first and second ends.

2. The pad of claim 1 in which said working part has a first length and a thickness and a first end portion, a middle portion and a second end portion, said thickness being constant in said middle portion and tapered in said first and second end portions, said middle portion having a second length, said second length being in the range of $\frac{1}{3}$ to $\frac{1}{2}$ of said first length.

* * * * *